US005366192A

United States Patent [19]

Carroll

[11] Patent Number: 5,366,192

[45] Date of Patent: Nov. 22, 1994

[54] APPARATUS FOR DISPLAYING A CARD AND AN OBJECT HAVING A STEM

[75] Inventor: William G. Carroll, Salt Lake City, Utah

[73] Assignee: Maxim, Inc., Salt Lake City, Utah

[21] Appl. No.: 957,829

[22] Filed: Oct. 8, 1992

[51] Int. Cl.[5] ..... A47G 7/00

[52] U.S. Cl. ..... 248/152; 40/642; 248/27.8

[58] Field of Search ..... 248/152, 153, 27.8; 211/70.1, 72, 73; 40/642, 645, 649

[56] References Cited

U.S. PATENT DOCUMENTS

| | | | |
|---|---|---|---|
| 1,518,207 | 12/1924 | McCauley | 248/152 X |
| 2,048,695 | 7/1936 | Hasenour | 211/74 X |
| 3,269,041 | 8/1966 | Marcus | 40/649 |
| 5,160,324 | 11/1992 | Halbach | 248/152 X |

*Primary Examiner*—David L. Talbott
*Attorney, Agent, or Firm*—Thorpe, North & Western

[57] ABSTRACT

A stand for holding a message or felicitation card vial and flower includes a generally planar base having a front edge and an upright plate extending upwardly from the front edge of the base, and having a top edge and a front face which faces forwardly of the front edge of the base, where the upright plate includes tabs for holding the card flat against the front face of the plate. Extending rearwardly of the top edge of the upright plate is an annulus which defines a circular opening, and on which is mounted a sleeve extending vertically upwardly from about the opening, directly above the base. A vial having an open upper end and a closed lower end is provided for disposition in the sleeve so that the closed lower end rests on the base and the open upper end is directed upwardly to receive and hold the stem of a flower.

5 Claims, 2 Drawing Sheets

APPARATUS FOR DISPLAYING A CARD AND AN OBJECT HAVING A STEM

BACKGROUND OF THE INVENTION

This invention relates to a combination message card and stemed-object holder or stand.

It has been tradition since time out of mind to express love, appreciation or sympathy by giving or sending flowers along with a card carrying the desired message. A variety of devices and structures have been devised for holding and presenting either the flowers or a flower, the card, or, in some cases, a combination of the two. An example of the latter device involves a structure having a base plate, a tube extending upwardly from the base plate for holding the stem of a flower, and a card holding plate also extending upwardly from the base plate and spaced from the tube. Such structure, although serving to hold both a card and a single flower, is bulky, difficult to manufacture since it requires assembling and attaching three separate parts together, and is generally aesthetically distracting.

SUMMARY OF THE INVENTION

It is an object of the invention to provide a simple, easy to fabricate, and aesthetically pleasing structure for holding a message card and a vial in which may be placed the stem of a flower or similar item.

It is also an object of the invention to provide such a structure which may be constructed of a single integral piece of material which is also functional and aesthetically attractive.

It is a further object of the invention to provide such a structure which may be stably placed upon a support surface to securely hold such a card, vial and stemmed object.

The above and other objects are realized in a specific illustrative embodiment of a card and vial holder comprising a base for resting on a support surface, a card holding section extending upwardly from the front of the base for receiving and holding a card in a generally upright position, said card holding section including an upper edge and a front side, and a vial holding section extending rearwardly of the card holding section from the upper edge thereof, and including a receptacle means into which a vial may be placed and held in a generally upright position with the vial opening directed upwardly and the bottom of the vial resting on the base.

In accordance with one aspect of the invention, the receptacle means is composed of a generally vertically oriented sleeve into which the vial may be placed and held in the upright position.

In accordance with another aspect of the invention, the base, card holding section and vial holding section are all formed from a single piece of material.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 3:
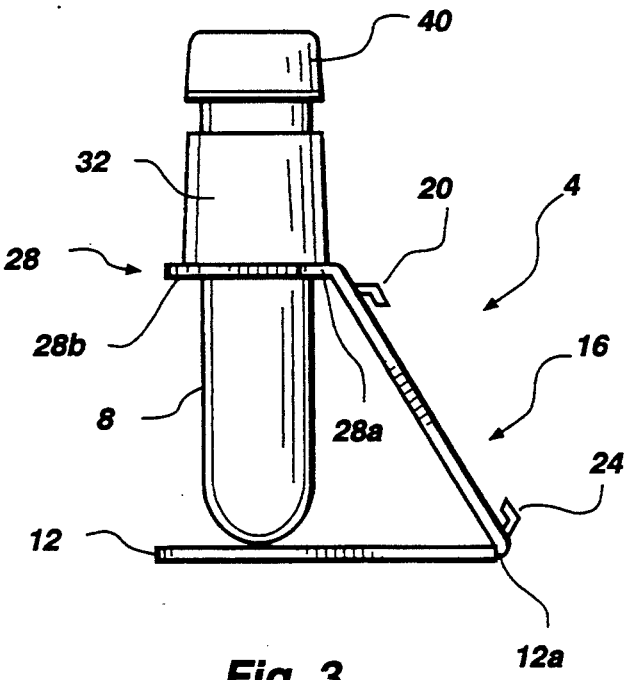
FIG. 3 is a side, elevational view thereof.

Referring to the drawings, there is shown a message card and vial holder or stand 4, in which is inserted a vial 8. The stand 4 is formed advantageously of a single piece of material, such as plastic, to include a base section 12 formed into a generally planar rectangular plate for resting on a support surface. Extending upwardly and rearwardly from a front edge 12*a* of the base 12 is a card holding section 16. The card holding section 16 advantageously forms an angle with the base section 12 of greater than 45 degrees (and thus an angle with the vertical of less than 45 degrees), as best seen in FIG. 3.

The card holding section 16 is formed with a generally planar rectangular frame 16*a* which circumscribes a rectangular opening 16*b*. Formed to extend forwardly and downwardly from the top of the frame 16*a* are a pair of spaced-apart fingers or tabs 20. Similarly, a pair of forwardly and upwardly directed, spaced-apart fingers or tabs 24 are formed on the bottom of the frame 16*a*, as shown in the drawings. The tabs 20 are spaced apart from tabs 24 a distance which generally corresponds to the width of conventional message or felicitation cards upon which are typically written greetings, sympathies, or other messages, so that such cards can be inserted between the two sets of tabs to lie flat against the frame 16*a* and be held in place by tabs.

Figure 1:
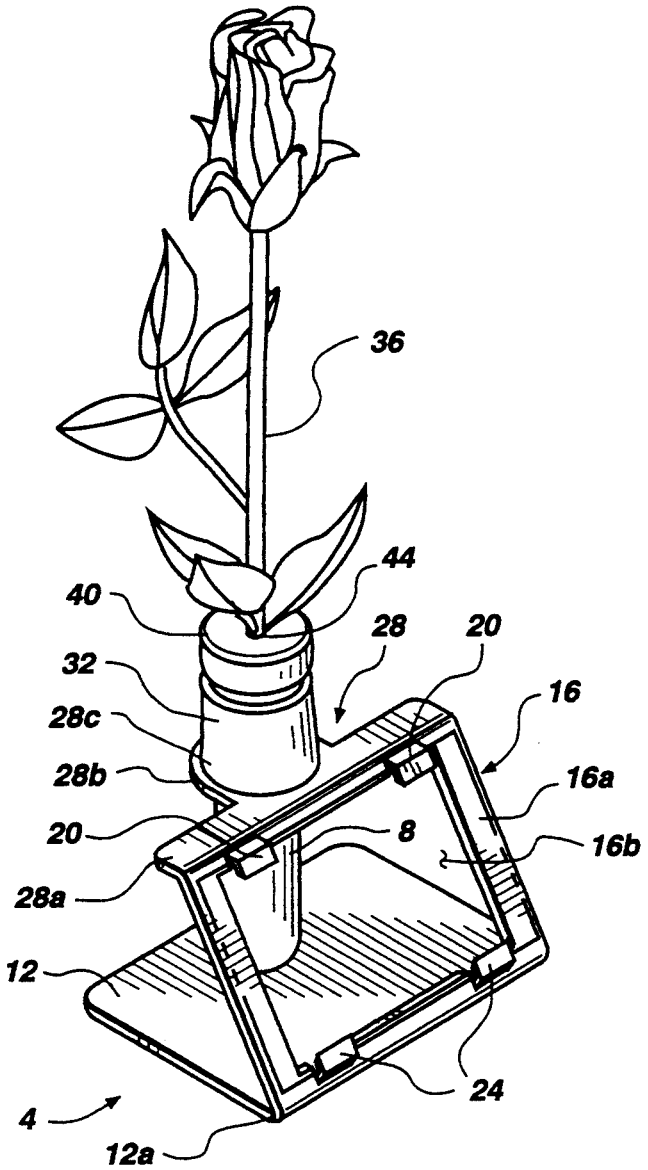
FIG. 1 is a perspective view of a card and vial holder, and vial, made in accordance with the principles of the present invention.
Figure 2:
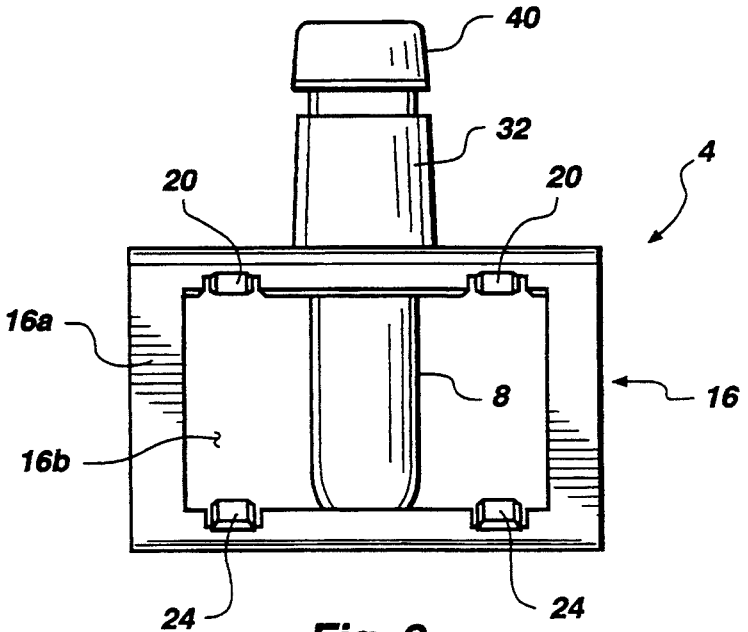
FIG. 2 is a front, elevational view of the card and vial holder, and vial, of FIG. 1.
Figure 4:
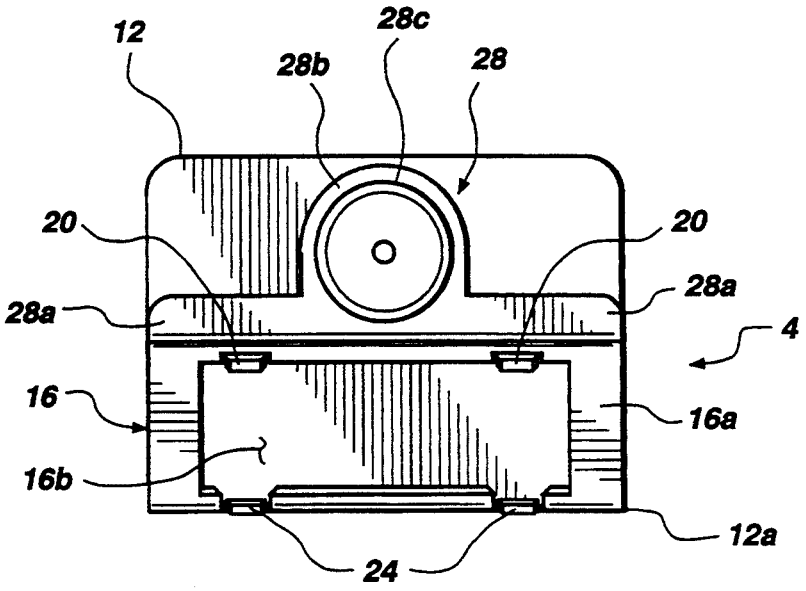
FIG. 4 is a top, plan view thereof.

Extending rearwardly from the top of the card holding section 16 is a vial holding section 28. The vial holding section 28 includes a narrow, generally planar strip 28*a* extending rearwardly from the upper edge of the card holding section 16, and an annulus 28*b* extending rearwardly from the strip 28*a* and defining a generally circular opening 28*c* (FIG. 4). Disposed on the annulus 28*b* to extend generally vertically upwardly from about the opening 28*c* is a cylindrical sleeve 32. The sleeve 32 and opening 28*c* are disposed above the base section 12 so that placement of the vial 8 in the sleeve 32 to extend downwardly through the opening 28*c* will result in the lower end of the vial 8 resting upon the base section 12, as best seen in FIGS. 1 and 3. The sleeve 32 holds the vial 8 in a vertically upright position for receiving a flower 36 or similar stemmed object. A cap 40 may be placed on the top of the vial 8 to better hold the flower in place by fitting the flower stem through a small opening 44 formed in the cap (FIG. 1).

In the manner described above, a structurally simple, easy to manufacture and aesthetically appealing card, vial and stemmed object holder or stand is provided. The stand advantageously is integrally formed of a single piece of material, for example, by injection molding or vacuum forming. The stand securely holds in an upright position a vial in which may be placed a flower with a stem. Of course, a card carrying a message to be conveyed to the recipient of the stand may be held securely in place on the front of the card holding section of the stand.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A card and vial holder comprising a base for resting on a support surface, a card holding section extending upwardly from the base for receiving and holding a card in a generally upright position, said card holding section including an upper edge, and a front side and rear side, and a vial holding section extending rearwardly of the card holding section from the upper edge thereof, and including a receptacle means into which a vial may be placed and held in a generally upright position with a vial opening directed upwardly, wherein said base, card holding section, and vial holding section are formed integrally with one another to include a base plate having a front portion and a rear portion, for lying generally flat on said support surface, said card holding section being formed to curve upwardly and rearwardly from the front portion of the base plate to an upper edge to present a generally planar surface for holding a card, and said vial holding section being formed to curve from the upper edge of the card holding section, rearwardly into a generally horizontal section having an opening into which a vial may be inserted.

2. A card and vial holder as in claim 1 wherein the base plate is formed so that its rear portion extends underneath the opening in the vial holding section to support the lower end of a vial inserted in the opening.

3. A card and vial holder as in claim 2 wherein said vial holding section includes a tubular member which extends generally vertically upwardly from about said opening, to circumscribe and hold a vial in a generally vertical orientation.

4. A card and vial holder as in claim 1 wherein said card holding section comprises a generally planar frame with a central opening circumscribed by a frame border, and tab means formed on the frame border for overlapping the edges of a card placed against the planar frame, to hold the card in place.

5. Structure for holding a card and a stemmed object comprising a generally planar base having a front edge, an upright plate extending upwardly from the front edge of the base, and having a top edge, and a front face, which faces forwardly of the front edge of the base, said upright plate including means for holding a card flat against the front face of the plate, collar means extending rearwardly from the top edge of the upright plate to define an opening disposed above the base, said collar means including a sleeve extending upwardly from about the opening to an elevation above the top edge of the upright plate, and a vial having an open upper end and a closed lower end for disposition in the sleeve so that the closed lower end rests on the base and the open upper end is directed upwardly to receive and hold the stem of a stemmed object.

* * * * *